US012186633B1

(12) United States Patent
Spear et al.

(10) Patent No.: US 12,186,633 B1
(45) **Date of Patent: *Jan. 7, 2025**

(54) SYSTEM AND ASSOCIATED METHODS FOR A DEVICE FOR SPORTS EQUIPMENT MAINTENANCE

(71) Applicant: bowlingball.com, Inc., Daytona Beach, FL (US)

(72) Inventors: Keith Spear, Daytona Beach, FL (US); Anthony Ruocco, Daytona Beach, FL (US)

(73) Assignee: BOWLNGBALL.COM, INC., Dayona Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/734,308

(22) Filed: Jun. 5, 2024

Related U.S. Application Data

(63) Continuation of application No. 18/513,076, filed on Nov. 17, 2023, now Pat. No. 12,005,320.

(51) Int. Cl.
*A63B 47/00* (2006.01)

(52) U.S. Cl.
CPC .... *A63B 47/005* (2013.01); *A63B 2243/0054* (2013.01)

(58) Field of Classification Search
CPC . A63B 47/005; A63B 47/007; A63B 2208/12; A63B 2209/00; A63B 2209/10; A63B 2225/093; A63B 2243/0054; A63B 2225/01; A63B 37/0001; A63B 2047/046; A63B 2225/30; A63B 2243/007; A63B 45/02; A63B 47/001; A63B 47/04; B32B 1/00; B32B 2250/03; B32B 2260/021; B32B 2260/046; B32B 2262/062; B32B 2262/101; B32B 2266/06; B32B 2266/08; B32B 2307/304; B32B 2307/518; B32B 2307/546; B32B 2307/5825; B32B 2307/7246; B32B 2307/732; B32B 27/065; B32B 27/12; B32B 27/32; B32B 27/36; B32B 5/02; B32B 5/18; B32B 2307/7242; B32B 2323/04; B32B 2367/00; B32B 2439/40; B32B 2439/46; B32B 27/08; B32B 3/266; B65D 81/3897; B65D 2313/02; B65D 33/005; B65D 33/06;

(Continued)

(56) References Cited

U.S. PATENT DOCUMENTS 4,140,893 A * 2/1979 Renteria ..... A63B 47/005 219/535
5,660,751 A * 8/1997 O'Rorke ..... F26B 9/003 219/386

(Continued)

*Primary Examiner* — Vy T Nguyen
(74) *Attorney, Agent, or Firm* — Mark Malek; Jonathan Staudt; Widerman Malek, PL

(57) ABSTRACT

A device for maintenance of sports equipment is provided. The device may comprise a lower housing, a wall, and a top member. The device may also comprise a heat element, a controller, and a mount. The wall may be removably connected to and extended upwardly from the lower housing. The top member may be removably carried by an upper portion of the wall. The heat element may be carried by the lower housing. The controller may be carried by the lower housing and may be in communication with the heat element. The mount may carry the sports equipment.

19 Claims, 5 Drawing Sheets

(58) Field of Classification Search
CPC .... B65D 33/24; B65D 61/00; B65D 81/3476; B65D 81/38; F26B 9/003; F26B 21/004; H05B 3/00; H05B 3/0033
USPC ..... 219/386, 201, 385, 521, 528, 202, 227, 219/400, 405, 411, 492, 494, 507, 523, 219/526, 533, 535; 134/105, 40; 206/315.91, 315.1, 315.9, 811; 473/125, 473/59, 106, 54; 224/901.6, 919; 392/384, 418
See application file for complete search history.

(56) References Cited

U.S. PATENT DOCUMENTS

2007/0082756 A1* 4/2007 Lee ..... A63B 47/005 473/378
2013/0340792 A1* 12/2013 Ott ..... A63D 5/10 15/3

* cited by examiner

SYSTEM AND ASSOCIATED METHODS FOR A DEVICE FOR SPORTS EQUIPMENT MAINTENANCE

RELATED APPLICATIONS

This application is a continuation application of and claims priority under 35 U.S.C. § 120 of U.S. patent application Ser. No. 18/513,076 filed on Nov. 17, 2023 and titled SYSTEM AND ASSOCIATED METHODS FOR A DEVICE FOR SPORTS EQUIPMENT MAINTENANCE. The content of this application is incorporated herein by reference except for where the content therein conflicts with the content herein.

FIELD OF THE INVENTION

The present invention relates to systems and methods for treating, maintaining, and/or repairing sports equipment, particularly including heat treatment of the sports equipment such as bowling balls.

BACKGROUND OF THE INVENTION

Sports equipment due to the extensive physical wear and tarnishing caused by their use in the course their respective sport, will necessitate either replacement, maintenance, or repair of the sports equipment. Specifically, in the sport of bowling, the bowling balls are exposed to numerous impacts, changes in temperature, as chemical exposure and build-up of various foreign substances. The chemical exposure and build-up can include that resulting from the use of grip powders by players, or wax/oil or other lubricants that may be used on the bowling lane on which the bowling ball will be thrown and rolled on.

The materials that bowling balls comprise, such as the material of the coverstock, are semi-soft and are notably porous and absorbent such that some chemicals, waxes/oils, and dirt can be absorbed and subsequently carried within the bowling ball. For non-competitive and/or infrequent players of bowling, the added weight to the bowling ball by the absorbed chemicals may be unnoticeable. However, for a frequent and/or competitive player of bowling, the change in weight and weight distribution of the bowling ball can cause noticeable and even significant changes in the performance of the bowling ball. These changes can become so significant as to render the bowling ball unusable for the player.

Generally, to extract the chemicals, and particularly the waxes/oils that have been absorbed by the bowling ball during its use, bowling balls are exposed to elevated temperatures to melt and extract the wax/oil and dirt from the bowling ball followed by a thorough cleaning of the exterior and coverstock of the bowling ball. The heating of the bowling ball is commonly done in an oven set to a low temperature or by heating the bowling ball in a large pot of water on a stovetop. However, neither of these options are consistent or easily portable to be available during tournaments that involve extended traveling periods.

Moreover, ovens and stovetops vary in reliability and consistency to maintain the temperature at a precise level to extract the dirt and waxes/oils from the bowling ball without being too low to be ineffective at removing the wax/oil or without becoming too high and cause damage to the bowling ball. Additionally, it can be difficult and dangerous for players to position the bowling ball safely and reliably in the oven and remove the heated bowling ball from either the oven or pot of hot water.

Therefore, there exists a need for a system and/or method of safely, reliably, and consistently heat sports equipment, mainly bowling balls, to extract foreign objects including dirt, chemicals, and waxes/oils which preferably includes a high level or portability for convenience while periods of travel.

This background information is provided to reveal information believed by the applicant to be of possible relevance to the present invention. No admission is necessarily intended, nor should be construed that any of the preceding information constitutes prior art against the present invention.

SUMMARY OF THE INVENTION

With the above in mind, embodiments of the present invention are related to a device for maintenance of sports equipment. The device may comprise a lower housing, a wall, a top member, a heat element, a controller, and a mount. The wall may be removably connected to and extending upward from the lower housing. The top member may be removably carried by an upper portion of the wall. The heat element may be carried by the lower housing. The controller may be carried by the lower housing and may be in communication with the heat element. The mount may carry the sports equipment.

The device may also include a display that may be carried by the lower housing. The device may further include an interface that may be carried by the lower housing. The device may yet further include an audio unit that may be carried by the lower housing. The controller may cause the audio unit to generate audible sound upon a predetermined event taking place.

The controller may be in communication with a user device to send and receive data signals therewith. The device may also include a timing unit that may be carried by the lower housing, and a fan that may be carried by the lower housing. The lower housing may comprise a mount connecting member. The mount may be removably carried by the mount connecting member.

The mount connecting member may be selectively rotatable, and rotation of the mount connecting member may respectively rotate the mount. The device may also include one or more of a vent formed in an internal surface of the lower housing, and a receptacle formed through an upper portion of the lower housing. The top member may comprise one or more of an upper vent formed therethrough. The upper vent may be movable between an opened position and a closed position.

The wall may include an upper rim and a lower rim. The upper rim may be engaged with either of a lower portion of the top member and the lower rim of an adjacent wall. The lower rim may be engaged with either of a housing rim of the lower housing and the upper rim of a different adjacent wall. The wall may also include wall sections that each may attach to adjacent wall sections to form the wall. The wall sections may each include one or more of an attachment member and a respective attachment point. The attachment member may be engaged with the respective attachment point of an adjacent wall sections to form the wall.

The mount may include one or more of a mount vent formed therethrough. The device may also include a thermal sensor that may be configured to sense a temperature of an interior area defined by the wall. The device may further include a weight sensor that may be carried by the lower housing and that may be in communication with the mount.

The weight sensor mat detect a weight of the sports equipment and may be carried by the mount.

Some embodiments of the present invention may be directed to a device for maintenance of sports equipment. The device may comprise a lower housing, a wall, and a top member. The device may also comprise a heat element, a mount connecting member, and a mount. The wall may be removably connected to and extending upward from the lower housing and the wall may comprise wall sections that each may attach to adjacent wall sections to form the wall. The top member may be removably carried by an upper portion of the wall. The heat element may be carried by the lower housing. The mount may carry the sports equipment. The mount may be removably carried by the mount connecting member. The mount may comprise one or more of a mount vent formed therethrough.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a sports equipment maintenance device 100 for heat treating sports equipment 190 for maintenance, repair, or regular upkeep of the physical characteristics or quality of the sports equipment. For increased terseness, but without limitation, through herein and the below description of the present invention, the sports equipment maintenance device 100 may simply be referred to as the device 100.

Figure 5:
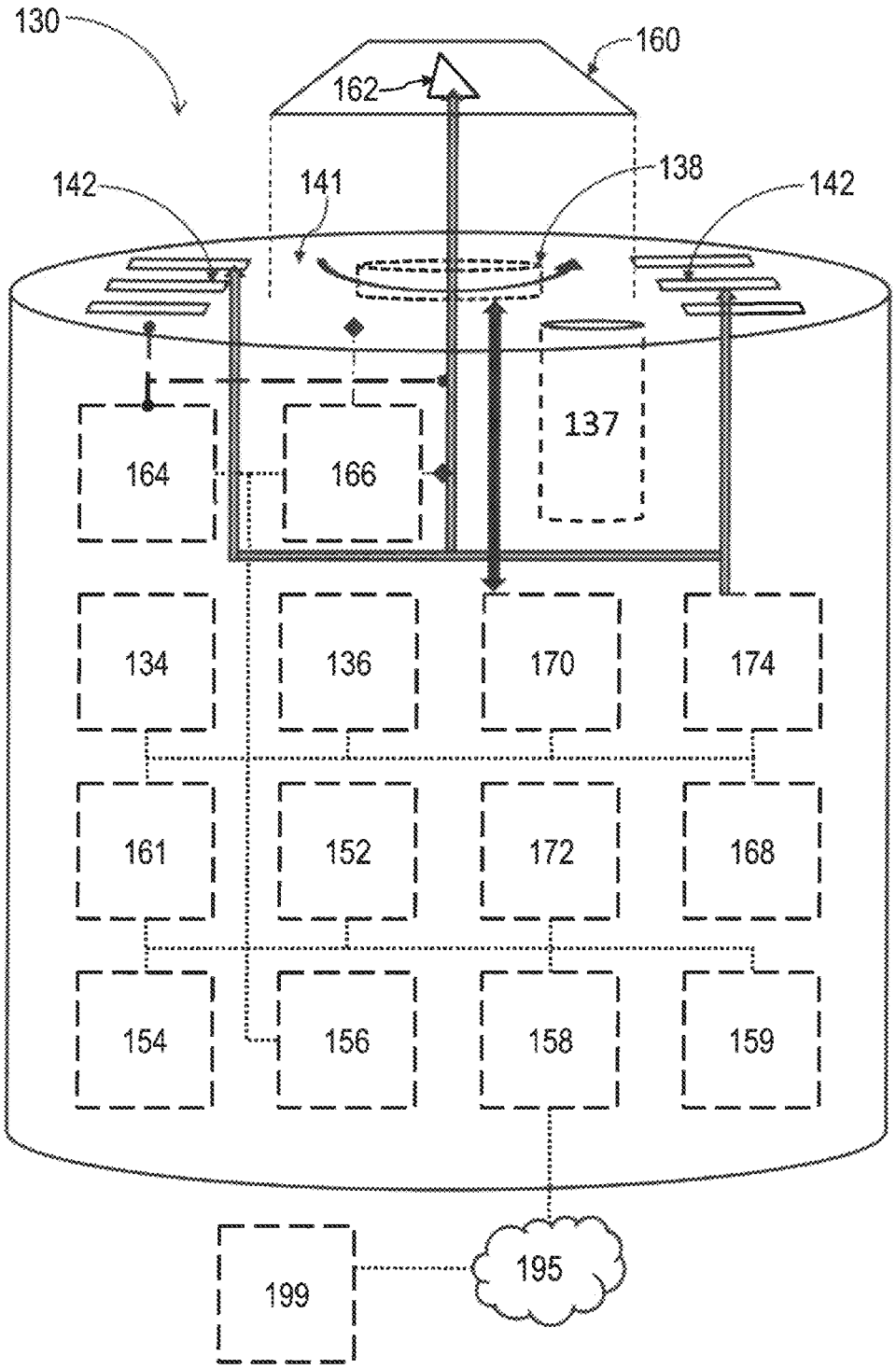
FIG. 5 is a schematic illustration of a device for maintaining sports equipment according to an embodiment of the present invention.

Initially referring to FIG. 5, embodiments of the present invention directed to the device 100 may include one or more of a lower housing 130, a wall 110, and a top member 102. The lower housing 130 may include one or more feet 132 positioned on a lower portion of the lower housing 130. The lower housing 130 may also include a housing body 133, an internal surface 141, and a housing rim 140. The internal surface 141 of the lower housing 130 may be positioned at an upper portion of the lower housing 130 and/or above the housing body 133 of the lower housing 130. The housing rim 140 may be positioned on and/or adjacent to, an outer perimeter of the internal surface 141, outer perimeter of the upper portion of the lower housing 130, and/or an upper portion of the housing body 133.

The housing rim 140 may comprise an inner portion and an outer portion. The inner portion of the housing rim 140 may have a circumference that is smaller than a circumference of the outer portion of the housing rim 140. The inner portion of the housing rim 140 may also be positioned relatively higher than the outer portion of the housing rim 140 with respect to the housing body 133 of the lower housing 130. The lower housing 130 may also include a mount connecting member 138 that may be positioned on an intermediate portion of the internal surface 141 of the lower housing 130 relative to the outer perimeter of the internal surface 141. The mount connecting member 138 may have a cylindrical shape.

In some embodiments of the present invention, the lower housing 130 may include one or more of a receptacle 137 and one or more fan vents 142. The receptacle 137 may be positioned extending through the internal surface 141 of the lower housing 130 and directed towards an interior area of the housing body 133. The one or more fan vents 142 may be positioned extending through the internal surface 141 of the lower housing 130 and directed towards an interior area within the housing body 133. In some embodiments of the present invention that include a plurality of fan vents 142, the fan vents 142 may be spaced apart from one another on the internal surface 141 of the lower housing 130. The fan vents 142 may also be positioned uniformly spaced apart from adjacent fan vents 142, and/or the fan vent 142 may also be positioned in/as a predetermined pattern on the internal surface 141 of the lower housing 130. It is contemplated that an embodiments of the present invention may include none or any number of fan vents 142 while still accomplishing all the goals, features, and advantages of the present invention. Further details regarding the fan vents 142 follow further below.

Figure 1:
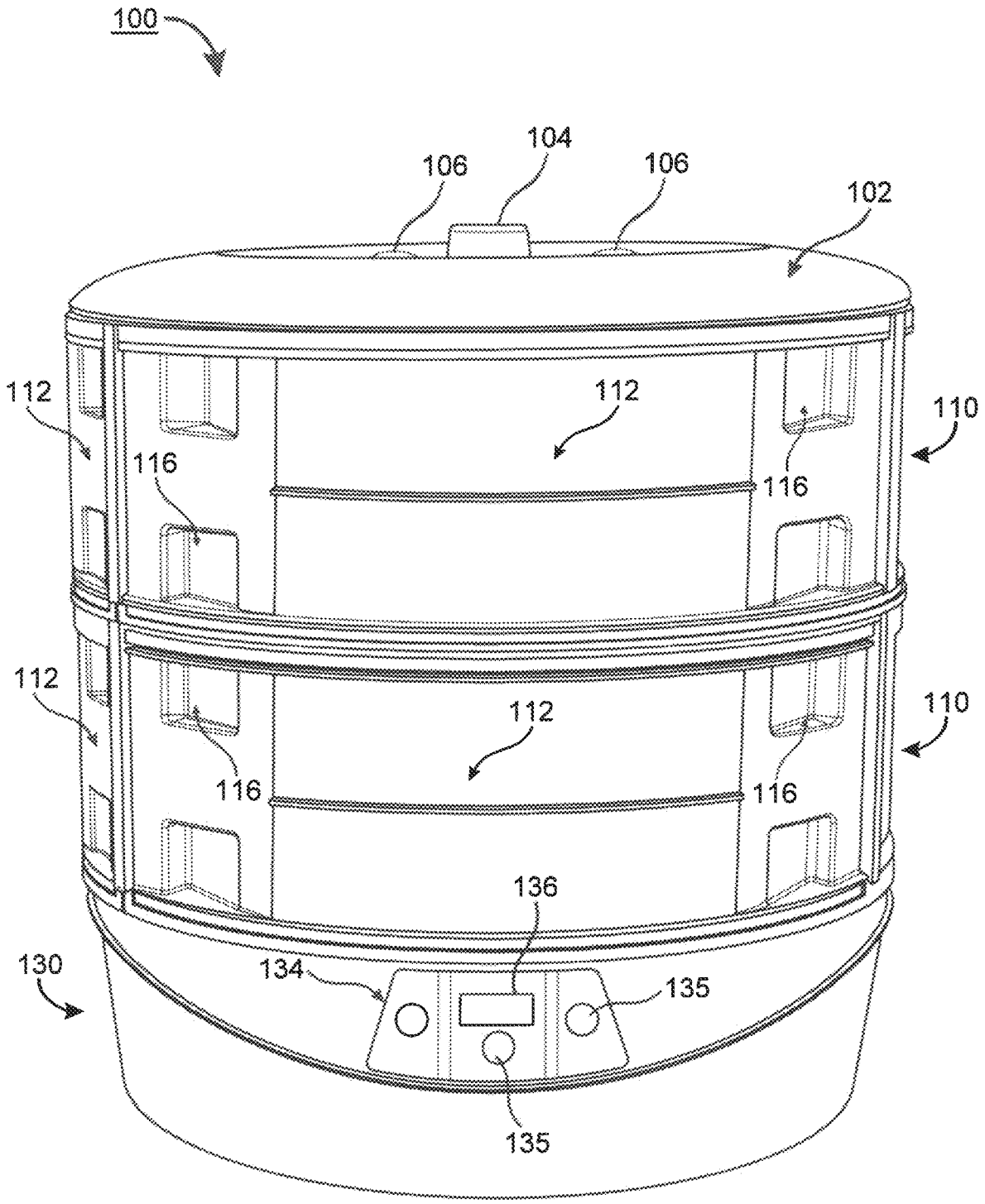
FIG. 1 is a perspective view of a device for maintaining sports equipment according to an embodiment of the present invention.
Figure 3:
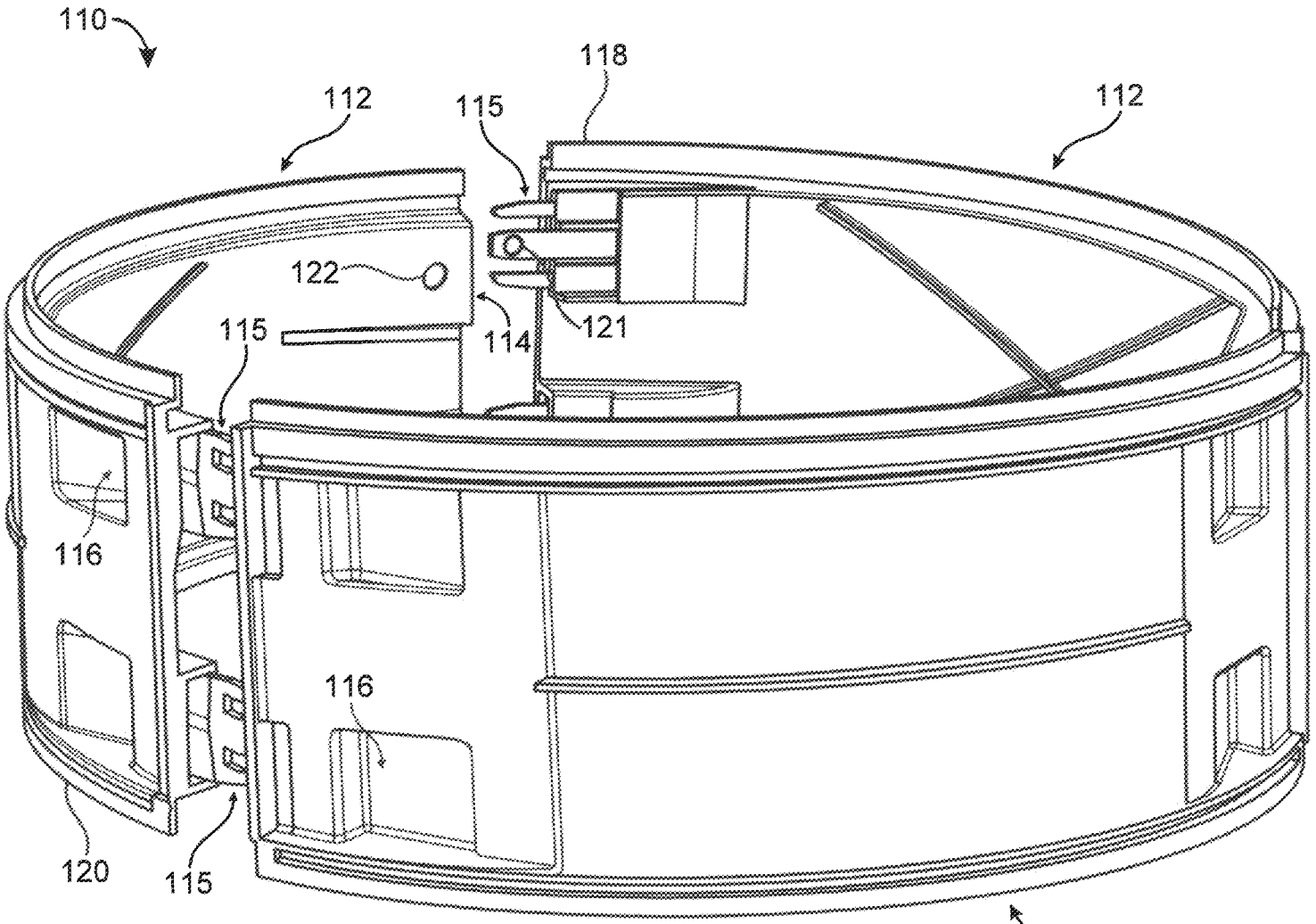
FIG. 3 is a perspective view of wall sections of the device illustrated in FIG. 1.
Figure 4:
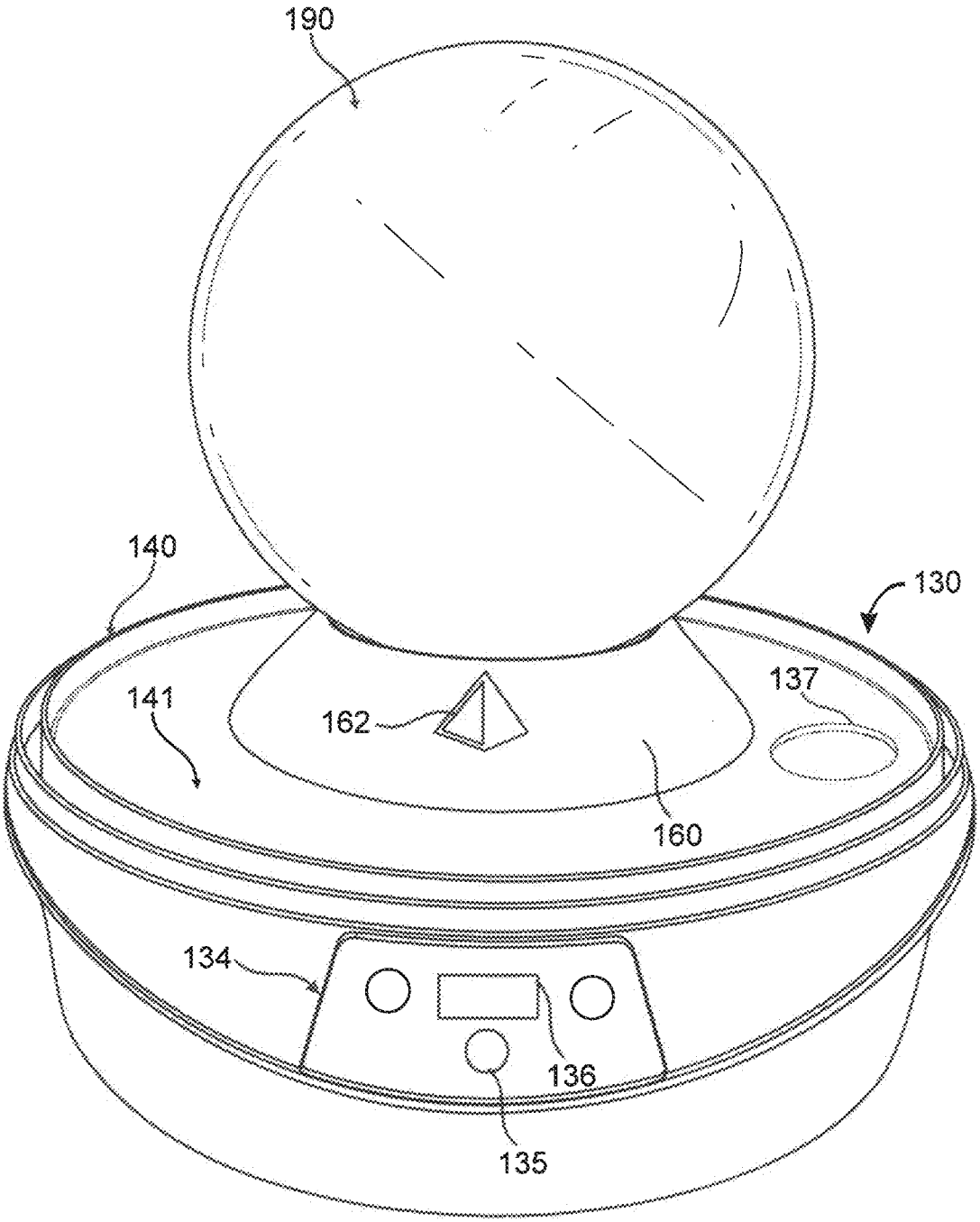
FIG. 4 is a perspective view of the lower housing illustrated in FIG. 2, as well as a mount of the device illustrated in FIG. 1 and showing a piece of sports equipment being carried by the mount.

Now additionally referring to FIGS. 1 and 3, embodiments of the present invention may include one or more walls 110. The walls 110 may include an upper rim 118 and a lower rim 120. The lower rim 120 may be configured to be removably matingly engaged with the housing rim 140 of the lower housing 130 and/or of the housing body 133. The lower rim 120 may also be configured to removably matingly engage with a portion of the housing rim 140 that may be located at or adjacent to a perimeter located between the outer portion of the housing rim 140 and the inner portion of the housing rim 140. The lower rim 120 of each wall 110 may be sized to have a perimeter that is smaller than a perimeter of the upper rim 118 of the respective wall 110. The wall(s) 110 may include a lower portion, an upper portion, an exterior face, and an interior face. The wall(s) 110 may define an interior area that may comprise a perimeter defined by an interior face of one or more wall(s) 110 that may be positioned above the lower housing 130.

Each wall 110 may include one or more wall sections 112. Each of the wall sections 112 may be removably matingly engaged with adjacent wall sections 110. The wall sections 112 may be removably matingly engaged with adjacent wall sections 112 to form a horizontal wall perimeter and/or to form the shape of, and/or, a wall 110. The horizontal wall perimeter formed by matingly engaging one or more wall sections 112 may, and/or a horizontal perimeter of a wall 110 may, have a shape similar to one or more of, but without limitation, a circle, oval, square, rectangle, triangle, hexagon, octagon, and any combinations thereof and any other two-dimensional geometric shape perimeter as understood by those skilled in the art.

The wall sections 112 may be matingly engageable with adjacent wall sections 112 to form the shape of, and/or to form a wall 110, with the shape of, or the wall 110, having the shape of one or more of a cylinder, cube, cuboid, triangular prism, and any combinations thereof and any other three-dimensional geometric shape as may be understood by those skilled in the art. Each wall section 112 may include an upper rim 118 and a lower rim 120 as defined above for a wall 110. The upper rim 118 and/or lower rim 120 of each wall section 112 may be positioned to be positioned adjacent to and/or abutting an upper rim 118 and/or a lower rim 120 of an adjacent wall section 112 which the wall section 112 may be matingly engaged therewith.

Each wall section 112 and/or each wall 110 may include one or more attachment members 115 and each all section 112 may include one or more attachment points 114. The attachment members 115 may be positioned at one or more inner side portions of a respective wall section 112. The attachment points 114 may be positioned at one or more inner side portions of a respective wall section 112 that may be an inner side portion that is an opposite inner side position of the inner side positioned of a respective attachment member 115 of the respective wall section 112. The attachment members 115 may be sized and configured to be removably matingly engaged with a respective attachment point 114 of an adjacent wall section 112.

Each attachment member 115 may include an engagement point 121, and each attachment point 114 may include an engagement channel 122. The engagement channel 122 may be positioned extending through a side portion of the attachment point 114. The engagement point 121 may be sized and positioned on the attachment member 115 such that the attachment point 121 may be removably matingly engaged with an engagement channel 122 of the attachment point 114 that the attachment member 115 may be removably matingly engaged therewith.

Each wall 110 and/or each wall section 112 may include a respective number of attachment recesses 116 as the number of each attachment point 114 and each attachment member 115 of the wall 110 and/or wall section 112. Each attachment recess 116 may be positioned adjacent to a respective attachment point 114 and/or a respective attachment member 115. Each attachment recess 116 may be extending through a portion of the wall 110 and/or a portion of the wall section 112 that may be adjacent to one of the attachment member(s) 115 and/or that may be adjacent to one of the attachment point(s) 114.

Some embodiments of the device 100 may include a top member 102. The top member 102 may include a handle 104 and one or more upper vents 106. The handle 104 may be positioned and/or attached to an upper intermediate portion of the top member 102. The one or more upper vents 106 may be positioned extending through a portion of the top member 102. The top member 102 may be configured to have an outer perimeter that may be configured to be removably engaged with and upper rim 118 of a wall 110, and upper rime 118 of one or more wall section 112, and/or the housing rim 140 of the lower housing 130. The upper vents 106 may be configured to move between an opened position and a closed position. The opened position of an upper vent 106 may be defined as when the interior area of the device 100 (as defined further below) is accessible through the upper vent 106. The opened position of an upper vent 106 may be defined as when the interior area of the device 100 is not accessible through the upper vent 106. The top member 102 may comprise a material that may be at least partially transparent with visible light.

Figure 2:
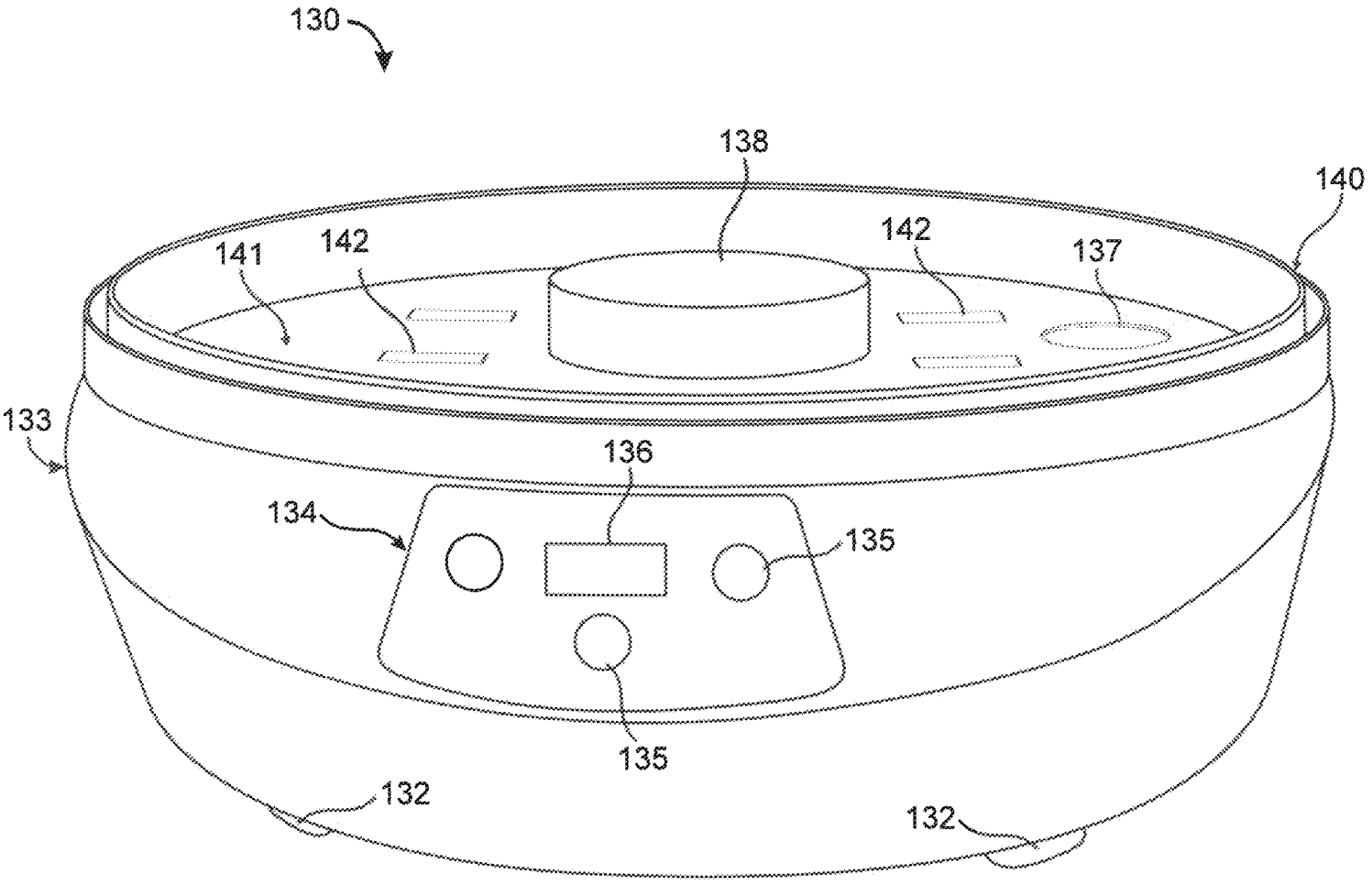
FIG. 2 is a perspective view of a lower housing of the device illustrated in FIG. 1.

Now referring to FIGS. 2 and 3, some embodiments of the present invention may include a mount 160. The mount 160 may be configured to be removably carried by, and/or matingly engaged with, a mount connecting member 138 of the lower housing 130. The mount 160 may be matingly engaged with the mount connecting member 138 at a bottom portion of the mount 160. The mount 160 may have a lower perimeter that may be larger with respect to a perimeter of the mount connecting member 138. The mount 160 may also include an upper perimeter that may be smaller with respect to the lower perimeter of the mount 160. The mount 160 may include a mount vent 162. The mount vent 162 may be extending through a portion of the mount 160 and the mount vent 162 may be extending towards an interior area of the mount 160. The mount vent 162 may be in fluid communication with one or more of the fan vent(s) 142, a fan 174, and a heat element 164. Further details on the fan 174 and the heat element 164 follow below.

The mount vent 162 may be shaped to have a cross sectional width perimeter that may comprise a two-dimensional geometric shape. For example, but without limitation, the cross sectional width perimeter of the mount vent 162 may comprise a two-dimensional geometric shape that may be similar to a triangle, a pyramid, a square, a rectangle, a hexagon, an octagon, an oval, and any combination thereof and any other two-dimensional geometric shape as understood by those skilled in the art.

An upper portion of the mount 160 may be shaped to carry one or more of a sports equipment 190 which may be exposed and/or uniformly to, an environment adjacent to and/or surrounding the sports equipment 190 while carried by the mount 160, and/or the interior area as defined by the interior face of the wall(s) 110 as defined further above. For example, but without limitation, the upper portion of the mount 160 may be shaped to carry one or more of a sports equipment 190 that may comprise a spherical shape, such as, a bowling ball. However, it is contemplated that the upper portion of the mount 160 may be shaped to carry one or more of a sports equipment 190 that may comprise any three-dimensional geometric shape, and is not limited to spherical shapes of bowling balls.

Now referring to FIGS. 1-2 and 4-5, the device 100 may include an interface 134. The interface 134 may be carried by the lower housing 130. The interface 134 may be positioned on a side portion of the lower housing 130 and/or the interface 134 may be positioned on a side portion of the housing body 133 of the lower housing 130. The interface may include a display 136 and one or more of an interface control 135.

The display 136 may be configured to display data and information that may be received by the display 136. The data and information displayed by the display 136 may include characters of an alphabet and/or numbers of a numerical system. The display 136 may also be configured and operable to read and interpret inputs made by a user via the display 136, and the display 136 may be configured to emit an input signal relating to a read and/or interpreted input may by a user via the display 136. Examples of the display 136 may include, but without limitation, a light emitting diode (LED) display, a touch screen display, liquid crystal display, segmented display, dot matrix display, and any combination thereof and any other type of display that may be used as the display 136 as may be understood by those skilled in the art. Further details on the display 136 follow below.

The one or more interface control(s) 135 may be positioned on the interface 134. The interface control(s) 135 may register, read, and/or interpret an input made by a user via the interface control(s) 135. The interface control(s) 135 may emit an input signal related to a registered, read, and/or interpreted input made by a user via the interface control(s) 135. Examples of the interface control(s) 135 include, but without limitation, a button, a touch sensing device, a switch, a key, a knob, a dial, a lever, and any combination thereof. In some embodiments of the present invention each interface control 135 may be configured to emit an input signal upon registering, reading, and/or interpreting an input made by a user via that interface control 135.

For example, but without limitation, each interface control 135 may emit an input signal upon registering, reading, and/or interpreting an input made by a user via the interface control 135. The input signal may be related to a timer signal, a start signal, a stop signal, a heat level signal, a fan signal, a rotation signal, a display signal, a network signal, and any combinations thereof. In some embodiments of the present invention that include more than one interface control 135, each interface control 135 may be configured to emit an input signal that is associated with that interface control 135 upon registering, reading, and/or interpreting an input made by a user via that interface control 135. For example, but without limitation, each interface control 135 may emit an input signal that is associated with that interface control 135 upon registering, reading, and/or interpreting an input made by a user via that interface control 135 which may be related to a timer signal, a start signal, a stop signal, a heat level signal, a fan signal, a rotation signal, a display signal, a network signal. Further details on the input signal (s) emitted by the interface control(s) 135 follows throughout below.

Now additionally referring to FIGS. 1-5, but as may be best illustrated in FIG. 5, in some embodiments of the present invention, the device 100 may include a controller 152, a memory unit 154, a datastore 156, a power unit 159, a heat element 164, a thermal sensor 166, and a fan 174. Moreover, in some embodiments of the present invention, the device 100 may include a network unit 158, an audio unit 161, a timing unit 168, a rotation unit 170, and a weight sensor 172. For the purposes of the disclosures of the embodiments of the present invention, and to increase the amount of terseness, but without any limitation, the terms powered component 200, powered components 200, powered components 200 of the present invention, powered components 200 of the device 100, and any semantically similar variation thereof, may refer to one or more of the device 100, the interface 134, the display 136, the interface control(s) 135, the controller 152, the memory unit 154, the data store 156, the network unit 158, the power unit 159, the audio unit 161, the heat element 164, the thermal sensor 166, the timing unit 168, the rotation unit 170, the weight sensor 172, the fan 174, a network 195, and a user device 199. Further details on each of the above, including the network 195 and the user device 199 follows throughout below.

The controller 152 may be carried by the lower housing 130. The controller 152 may be in communication with one or more of the powered components 200 of the device 100 and in communication with any combinations thereof. The controller 152 may be utilized to receive, send, read, write, interpret, compute, and run machine-readable data and information that may be stored by and/or received by the controller 152. The controller 152 may also be utilized to monitor, control, and otherwise manage the function(s), status(es), and/or operation(s) of one or more of the powered components 200 of the device 100. Examples of the controller 152 include, but without limitation, a processor, a desktop processor, a mobile device processor, a microcontroller, a central processing unit, a field programmable gate array, microprocessor, a coprocessor, and any combinations thereof. The controller 152 may be configured to have selective control of one or more of the powered components 200 of an embodiment of the present invention The controller 152 may also be configured to selectively control the one or more powered components 200 based on one or more of predetermined parameters, a signal received by the controller 152, and/or an input signal received by the controller 152 that may be received via/from the network 195, user device 199, and/or from one or more of the powered components 200 including the interface 134, the display 136, and the interface control(s) 135. Further details on the controller 152 follow throughout below.

The memory unit 154 may be carried by the lower housing 130 and the memory unit 154 may be in communication with one or more of the powered components 200 of the device 100. The memory unit 154 may be configured to read, write, send, receive, and/or store machine-readable data and information. Examples of the memory unit 154 include, but without limitation, one or more of random access memory, volatile computer-readable memory, non-volatile computer-readable memory, solid state memory, and any combinations thereof. In one example, the memory unit 154 may include any number of program modules, such as, and without limitation, an operating system, one or more application programs, other program modules, program data, and any combinations thereof.

The datastore 156 may be carried by the lower housing 130. The datastore may be in communication with one or more of the powered components 200 of the device 100.

Example of the datastore 156 include, but are not limited to, a hard disk drive, a magnetic disk drive, an optical disc drive in combination with an optical medium, a solid-state memory device, and any combinations thereof. The datastore 156 may be configured to provide nonvolatile and/or volatile storage of computer-readable instructions, data structures, code, commands, program modules, and/or any other data for a computer system and/or the controller 152 as understood by those skilled in the art. In one example, the instructions may reside, completely, or partially, within the datastore 156. In another example, the instructions may reside, completely or partially, within the controller 152 or the memory unit 154.

The network unit 158 may be carried by the lower housing 130. The network unit 158 may be in communication with one or more of the powered components 200 of the device 100, including the controller 152, the network 195, and the user device 199. The network unit 158 may be utilized to connect and/or connect communication to, from, and between one or more of the powered components 200 including the controller 152, the network 195, and the user device 199 which may be a connection and/or communication that may comprise wired or wireless communication. Examples of the network unit 143 include, but without limitation, a network interface card, a modem, a router, a hub, a network bus, and any combinations thereof.

The network 195 may be selectively communication with one or more of the powered components 200 of the device 100, including the network unit 158 and/or the controller 152. The network 195 may be utilized to connect, manage, monitor, facilitate, and/or allow communication of one or more of the powered components 200 and the user device 199 to, from, and/or between one another via the network 195. The network 195 may comprise one or more of, but without limitation, a wireless network, a wired network, a peer-to-peer network, Wi-Fi, Bluetooth, near-field-communication (NFC), and any combinations thereof.

The power unit 159 may be carried by the lower housing 130, and the power unit may be in communication with one or more of the powered components 200 of the device 100. The power unit 159 may also be in communication with an external power source (not shown), such as, but without limitation, a power outlet, and any other external power source as may be understood by those with skill in the art. The power unit 159 may be utilized to provide electrical power to one or more of the powered components 200 of the device 100. Examples of the power unit 159 may include, but without limitation, a battery, a transformer, a power regulator, an inverter, a rectifier, a voltage regulator, an amperage regulator, a capacitor, a super-capacitor, and any combinations thereof.

Some embodiments of the present invention may include an audio unit 161. The audio unit 161 may be carried by the lower housing 130, and the audio unit 161 may be in communication with one or more of the powered components 200 of the device 100. The audio unit 161 may be configured to emit sound and audio noises, and the audio unit 161 may be configured to emit sound and audio noises that may be based on a signal and/or audio signal received by the audio unit 161 from one or more of the powered components 200 of the device 100.

The thermal sensor 166 may be carried by the lower housing 130. The thermal sensor 166 may be in communication with one or more of the powered components 200 of the device 100 which may include being in communication with the controller 152. The thermal sensor 166 may be configured to determine, sense, and monitor a temperature of an area and/or surface adjacent to, and/or an area/surface in view of, the thermal sensor 166, such as, and without limitation, the interior area of the wall(s) 110, an area above the lower housing 130, the internal surface 141 of the lower housing 130, an area below the top member 102, and/or a surface temperature of a sports equipment 190 that may be carried by the mount 160. The thermal sensor 166 may also be configured to emit a temperature signal that may relate to a determined, sensed, and/or monitored temperature of the area and/or surface adjacent to, and/or the area/surface in view of, the thermal sensor 166, such as the interior area of the wall(s) 110. The thermal sensor 166 may comprise, and without limitation, one or more of a thermocouple, a thermistor, infrared sensor, semiconductor temperature sensor, thermometer, surface temperature sensor, contactless temperature sensor, digital temperature sensor, and any combinations thereof. The heat element 164 may be carried by the lower housing 130. It is contemplated that some embodiments of the present invention may also include multiple heat elements 164 that may be carried by the lower housing 130. The heat element 164 may be in communication with one or more of the powered components 200 of the device 100. The heat element 164 may be configured to selectively generate heat that may be applied to and/or at one or more of an area above the lower housing 130, the internal surface 141 of the lower housing 130, an area within one or more of the walls 110, an area below the top member 102, and/or a surface of a sports equipment 190 that may be carried by the mount 160. Examples of the heat element 164 include, but without limitation, electric resistance heating element, coil heating element, ceramic heating element, wire heating element, positive temperature coefficient heater, infrared heater, quartz tube heater, induction heater, chemical heater, flame heater, and any combinations thereof. The heat element 164 may also be selectively controlled by the controller 152 to selectively generate heat, which may be based on an input signal received by the controller 152 from one or more of the powered components 200 of the device 100 including the interface 134, the display 136, the interface control 135, and the user device 199.

In some embodiments of the present invention, the fan vents 142 may be positioned on the internal surface 141 of the lower housing 130 and positioned at an angle relative to the internal surface 141 of the lower housing 130 to cause the heat generated by the heat element 164 to be circulated in the interior area defined by the wall(s) 110 in a circular direction with respect to the internal surface 141, the mount 160, the mount connecting member 138, and/or the lower housing 130.

Some embodiments of the present invention may include a timing unit 168. The timing unit 168 may be carried by the lower housing 130. The timing unit 168 may be in communication with one or more powered components 200 including the controller 152, the power unit 159, the interface 134, the display 136, and the interface control(s) 135. The timing unit 168 may be utilized to perform a count down from, and/or count up to, a time limit that may be based on a time signal that may be received by the timing unit 168 from one or more of the powered components 200 including the controller 152, the power unit 159, the interface 134, the display 136, and the interface control(s) 135. The time unit 168 may also emit a time signal that may relate to the count down from, and/or count up to, the time limit. The time signal emitted from the timing unit 168 may also relate to a point of time at which the timing unit 168 is counting down from, and/or counting up to, the time limit including, but without limitation, the timing unit 168 counting at a point of time equal to zero, the time limit, and/or at a point of time the timing unit 168 is at between zero and the time limit.

For example, and without limitation, the timing unit 168 may receive a time signal from the controller 152, the power unit 159, the interface 134, the display 136, and/or the interface control(s) 135 relating to counting down from forty-five minutes (45 min) and begin counting down to zero from 45 min, and the timing unit 168 may emit a time signal relating to the timing unit's 168 current count between the time limit of 45 min and zero, and the timing unit 168 may emit a time signal relating to the timing unit's 168 current count being zero. The timing unit 168 may comprise, but without limitation, one or more of a crystal oscillator, a digital counter, an analog counter, an atomic clock, a frequency counter, a pulse counter, a digital tachometer, network synchronized timer/clock, and any combinations thereof. In some embodiments of the present invention, it is contemplated that the timing unit 168 and the features of the timing unit 168 described herein may be instead integrated into the control unit 152 or any of the other powered components 200 of the device 100 such that the device 100 may not include a dedicated timing unit 168.

Some embodiments of the present invention may include a rotation unit 170. The rotation unit 170 may be carried by the lower housing 130, and the rotation unit 170 may be in communication with one or more of the powered components 200 of an embodiment the present invention. The rotation unit 170 may also be in mechanical communication with the mount connecting member 138 and the mount 160. The rotation unit 170 may be configured to selectively cause the mount connecting member 138 and/or the mount 160 to rotatably move relative to the lower housing 130, which may cause a sports equipment 190 being carried by the mount 160 to also rotatably move relative the lower housing 130. The rotation unit 170 may also be configured to be selectively controlled by the controller 152 to selectively cause the mount connecting member 138 and/or the mount 160 to rotatably move relative to the lower housing 130. The rotation unit 170 may be configured to selectively cause the mount connecting member 138 and/or the mount 160 to rotatably move in a direction relative to the lower housing 130 including, but without limitation, clockwise and counterclockwise. The rotation unit 170 may comprise, but without limitation, one or more of a motor, step motor, gear, belt, wheel, bearings, rotational engagement rod, and any combinations thereof.

In some embodiments of the present invention, and as may be understood by those that may have skill in the art, the mount connecting member 138 and/or the mount 160 of a device 100 may be configured to selectively rotatably move with respect to the lower housing 130 and/or the internal surface 141 of the lower housing 130 which may cause a sports equipment 190 carried by the mount 160 to rotatably move with the mount connecting member 138 and/or the mount 160 such that the device 100 may not include a dedicated rotation unit 170 as described above and herein. The mount connecting member 138 and/or the mount 160 may be in communication with one or more of the powered components 200 of the device 100, and the mount connecting member 138 and/or the mount 160 may be selectively controlled by one or more of the powered components 200 to cause the mount connecting member 138 and/or the mount 160 to selectively rotatably move.

The rotation unit 170, the mount connecting member 138, and/or the mount 160, may be configured to selectively rotatably move in a direction that is in the same circular direction of the heat generated by the heat element 164, in an opposite direction as the circular direction of the heat generated by the heat element 164, and alternate between selectively rotatably moving in the same and in the opposite direction as the circular direction of the heat generated by the heat element 164. The controller 152 may be configured to generate a time signal as described above, and/or the controller 152 may be configured to receive a time signal emitted from the timing unit 168 as also described above, and the controller 152 may selectively control the rotatable movement of the rotation unit 170, the mount connecting member 138, and/or the mount 160 based on the time signal generated and/or received by the controller 152. The controller 152 may also be configured to selectively control the heat element 164 to selectively generate heat based on the time signal generated and/or received by the controller 152.

Some embodiments of the present invention may also include one or more of a fan 174. The fan 174 may be in communication with one or more of the powered components 200 of the device 100, and the fan 174 may be configured to be selectively controlled by one or more of the powered components 200, such as, by the controller 152. The fan 174 may be carried by the lower housing 130, and the fan 174 may be mounted on a portion of the lower housing 130, the internal surface 141 of the housing 130, and the housing body 133. The fan 174 may be positioned on and/or within the lower housing 130, the internal surface 141 of the housing 130, and the housing body 133. The fan 174 may also be positioned above the lower housing 130 and/or positioned above the internal surface 141 of the lower housing 130. The fan 174 may be utilized to push and/or circulate ambient air into and/or within an area above the lower housing 130 and/or into/within at least one wall 110 positioned above the lower housing 130.

In some embodiments of the present invention, the fan 174 may also be positioned and utilized to push and/or circulate ambient air from within the lower housing 130 and through one or more of the fan vent(s) 142 into and/or within an area above the lower housing 130 and/or into/within at least one wall 110 positioned above the lower housing 130. The ambient air pushed and/or circulated by the fan 174 may be in a certain direction relative to the lower housing 130, and the ambient air pushed and/or circulated by the fan 174 may include any of the heat generated by the heat element 164. The fan 174 may push and/or circulate ambient air in a certain direction relative to the lower housing 130 including, but without limitation, clockwise, counterclockwise, away from, towards, and/or in an opposite direction as the heat generated by the heat element 164 through the fan vent(s) 142, and in the same direction as the heat generated by the heat element 164 through the fan vent(s) 142. In some embodiments of the present invention, the rotation unit 170 may cause the mount 160 and/or the mount connection member 138 to rotatably move relative to the lower housing 130 in a direction that may be in the same and/or opposite direction as the ambient air pushed/circulated by the fan 174, and/or the as the heat generated by the heat element 164 through the fan vent(s) 142.

In some embodiments of the present invention, the device 100 may include a weight sensor 172. The weight sensor 172 may be carried by the lower housing 130. The weight sensor 172 may be selectively in communication with one or more of the powered components 200 of the device 100 and with the mount 160, mount connecting member 138, and/or the sports equipment 190 that may be carried by the mount 160. The weight sensor 172 may be positioned and/or configured to detect a weight of one or more of the mount 160, mount connecting member 138, and/or the sports equipment 190 that may be carried by the mount 160. The weight sensor 172 may also be configured to emit a weight signal relating to a detected weight of one or more of the mount 160, mount connecting member 138, and/or a sports equipment 190 that may be carried by the mount 160. The weight signal emitted by the weight sensor 172 may be received by one or more of the powered components 200, such as, but without limitation, the controller 152 may receive the weight signal emitted by the weight sensor 172.

The controller 152 may cause and/or selectively control one or more the powered components 200 to take a predetermined action that may be based upon the controller 152 comparing and determining that a weight signal received by the controller 152 may be greater than, lower than, or equal to a predetermined upper weight value and/or a predetermined low weight value. In one example, but without limitation, the controller 152 may receive a weight signal from the weight sensor 172 that may be equal to and/or below a predetermined low weight value. The controller 152 may compare the weight signal to the predetermined low weight value and determine if the weight signal is lower than or equal to the predetermined low weight value. If the controller 152 determines that the weight signal is lower than or equal to the predetermined low weight value, the controller 152 may cause one or more of, the heat element 164 to stop generating heat, the fan 174 to stop pushing air, the audio member 161 to generate a noise or audible sound, and the display 136 to display information relating to the device 100 ending its current operation.

In another example, but without limitation, the controller 152 may receive a weight signal from the weight sensor 172 that may be equal to and/or greater than a predetermined upper weight value. The controller 152 may compare the weight signal to the predetermined upper weight value and determine if the weight signal is greater than and/or equal to the predetermined upper weight value. If the controller 152 determines that the weight signal is greater than and/or equal to the predetermined upper weight value, the controller 152 may cause one or more of, the heat element 164 to begin generating heat, the heat element 164 to continue generating heat, the heat element 164 to increase the amount of heat generated, the fan 174 to begin pushing air, the audio member 161 to generate a noise or audible sound, and the display 136 to display information relating to the controller 152 causing one or more of the powered components 200 of the device 100 to take one or more of the above mentioned actions.

In some embodiments of the present invention, the heat generated by the heat element 164 may cause a sports equipment 190 that may be carried by the mount 160 and that may be exposed to the generated heat to increase in temperature and excrete and/or release substances or fluids that may be carried by the sports equipment 190. For example, and without limitation, the heat generated by the heat element 164 may cause a sports equipment 190 that may be carried by the mount 160 and that may be exposed to the generated heat to increase in temperature and excrete and/or release substances or fluids that may be carried by the sports equipment 190 including substances or fluids such as, but without limitation, oil, bowling lane oil, bodily user oil, wax, dirt, soot, dust, and any combination thereof. As may be understood by those who may have skill in the art, throughout the description of the present invention the use of the term "wax" or "waxes" may be used interchangeably with and/or with reference to the terms "oil" and "oils," without any limitation thereby. In some embodiments of the present invention that include a receptacle 137, the receptacle 137 may be positioned on the lower housing 130 and/or the internal surface 141 of the lower housing 130 to capture substances or fluids that are excreted and/or released from a sports equipment 190 that may be carried by the mount 160. In some embodiments of the present invention, the internal surface 141 of the lower housing 130 may be shaped to have a gradient that may be sloped directed towards an upper portion of the receptacle which may assist the receptacle 137 in capturing the substances or fluids released from a sport equipment 190 carried by the mount 160 and heated by the heat generated by the heat element 164.

In some embodiments of the present invention, the controller 152 may be configured to selectively control the audio unit 161, and/or send an audio signal to the audio unit 161, to cause the audio unit 161 to emit a sound and audio noise upon the controller 152 determining that a predetermined event has taken place. For example, but without limitation, the controller 152 may receive a time signal from the timing unit 168, and/or generate a time signal that may relate to the time count by the time count by the controller 152 and/or timing unit 168 has reached a count of zero and/or reached the time limit and determine that a predetermined end time event has taken place and control the audio unit 161 and/or send an audio signal to the audio unit 161 to cause the audio unit 161 to emit a noise or audio sound that the time limit has ended.

In some embodiments of the present invention, the controller 152 may receive one or more of the input signals that may have been emitted by one or more of the interface control(s) 135 and cause one or more of the powered components 200 of the device 100 to take and action. As mentioned further above, the one or more input signals may be related to a timer signal, a start signal, a stop signal, a rotation signal, a heat level signal, a fan signal, a rotation signal, a display signal, a network signal, and any combinations thereof upon one or more of the interface control(s) 135 registering, reading, and/or interpreting an input made by a user via the interface control 135. For example, but without limitation, the controller 152 may receive one or more of the input signal and determine and selectively control and/or cause one or more of the powered components 200 to take a predetermined action including one or more of, causing the heat element 164 to start, stop, increase, and/or decrease generating heat, causing the rotation unit 170, the mount 160, and/or the mount connecting member 138 to start, stop, and/or change direction of its rotatable movement thereof, cause the fan 174 to start, stop, increase, and/or decrease pushing air, cause the audio unit 161 to emit a predetermined audio sound, and cause the timing unit 168 and/or the controller 152 to start or stop counting up to, or down from, a time limit or increase or decrease the time limit.

In some embodiments of the present invention, the device 100 and/or one or more powered components 200 of the device 100 may selectively be in communication with a user device 199. The communication between one or more powered components 200 and the user device 199 may be via the network 195 and/or via the network unit 158. The user device 199 and the controller 152 may be configured to send machine-readable data and instructions to, from, and/or between one another. The controller 152 may send data signals relating to data and information of the current operation of one or more of the powered components 200 of the device 100 to the user device 199. The user device 199 may received the data signals from the controller 152 and display the data and information of the data signal on the user device 199 to be perceived by a user of the user device 199. As may be understood by those that may be skilled in the art, the user device 199 may comprise one or more of a smart phone, a computer tablet, a personal computer, a desktop computer, a laptop computer, a smart watch computer, a computer terminal, a computer interface, and any combinations thereof.

The user device 199 may be operable to selectively send one or more command instructions to the controller 152 to cause the controller 152 and/or one or more of the powered components 200 of the device 100 to take a predetermined action. The command instruction may relate to one or more commands including turn a timer selection, a start selection, a stop selection, a rotation selection, a heat selection, a fan selection, a display selection, a network selection, and any combinations thereof. The controller 152 may receive the command instructions from the user device 199 and determine and cause one or more of the powered components 200 to take a predetermined action based on the command instruction(s) received by the controller 152. For example, but without limitation, a user may operate the user device 199 to send one or more command instructions to the controller 152, and the controller 152 may receive the command instructions from the user device 199 and determine a predetermined action based thereon including one or more of causing the heat element 164 to start, stop, increase, and/or decrease generating heat, causing the rotation unit 170, the mount 160, and/or the mount connecting member 138 to start, stop, and/or change direction of its rotatable movement thereof, cause the fan 174 to start, stop, increase, and/or decrease pushing air, cause the audio unit 161 to emit a predetermined audio sound, and cause the timing unit 168 and/or the controller 152 to start or stop counting up to, or down from, a time limit or increase or decrease the time limit.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A device for maintenance of sports equipment comprising:

a lower housing;

a wall removably connected to and extending upwardly from the lower housing;

a top member removably carried by an upper portion of the wall:

a heat element carried by the lower housing;

a controller carried by the lower housing and in communication with the heat element; and a mount to carry the sports equipment, wherein the lower housing comprises a mount connecting member, and wherein the mount is removably carried by the mount connecting member.

2. The device of claim 1, further comprising a display carried by the lower housing.

3. The device of claim 1, further comprising an interface carried by the lower housing.

4. The device of claim 1, further comprising an audio unit carried by the lower housing; wherein the controller causes the audio unit to generate audible sound upon a predetermined event taking place.

5. The device of claim 1, wherein the controller is in communication with a user device to send and receive data signals therewith.

6. The device of claim 1, further comprising a timing unit carried by the lower housing, and a fan carried by the lower housing.

7. The device of claim 1, wherein the mount connecting member is selectively rotatable; and wherein rotation of the mount connecting member respectively rotates the mount.

8. The device of claim 1, further comprising at least one vent formed in an internal surface of the lower housing, and a receptacle formed through an upper portion of the lower housing.

9. The device of claim 1, wherein the top member comprises at least one upper vent formed therethrough; and wherein the at least one upper vent is movable between an opened position and a closed position.

10. The device of claim 1, wherein the wall includes an upper rim and a lower rim; wherein the upper rim is selectively matingly engageable with either of a lower portion of the top member and the lower rim of an adjacent wall; and wherein the lower rim is selectively matingly engageable with either of a housing rim of the lower housing and the upper rim of a different adjacent wall.

11. The device of claim 1, wherein the wall comprises a plurality of wall sections that each attach to adjacent wall sections of the plurality of wall sections to form the wall; wherein the plurality of wall sections each include at least one attachment member and a respective attachment point; wherein the at least one attachment member is selectively matingly engageable with the respective attachment point of an adjacent wall section of the plurality of wall sections to form the wall.

12. The device of claim 1, wherein the mount comprises at least one mount vent formed therethrough.

13. The device of claim 1, further comprising a thermal sensor configured to sense a temperature of an interior area defined by the wall.

14. The device of claim 1, further comprising a weight sensor carried by the lower housing and in communication with the mount; wherein the weight sensor detects a weight of the sports equipment carried by the mount.

15. A device for maintenance of sports equipment comprising:

a lower housing comprising a mount connecting member;

a wall removably connected to and extending upwardly from the lower housing and comprising a plurality of wall sections that each attach to adjacent wall sections of the plurality of wall sections to form the wall;

a top member removably carried by an upper portion of the wall;

a heat element carried by the lower housing;

a controller carried by the lower housing; and a mount to carry the sports equipment;

wherein the mount is removably carried by the mount connecting member; and wherein the mount comprises at least one mount vent formed therethrough.

16. The device of claim 15, further comprising a display and an interface that are each carried by the lower housing; wherein the controller is in communication with the heat element.

17. The device of claim 15, further comprising an audio unit, a timing unit, and a fan that are each carried by the lower housing; wherein the controller is in communication with a user device to send and receive data signals therewith; and wherein the controller caused the audio unit to generate audible sound upon a predetermined event taking place.

18. The device of claim 16, further comprising at least one vent formed in an internal surface of the lower housing, and a receptacle formed through an upper portion of the lower housing; wherein the top member comprises at least one upper vent formed therethrough; wherein the at least one upper vent is movable between an opened position and a closed position; wherein the wall includes an upper rim and a lower rim; wherein the upper rim is selectively matingly engageable with either of a lower portion of the top member and the lower rim of an adjacent wall; and wherein the lower rim is selectively matingly engageable with either of a housing rim of the lower housing and the upper rim of a different adjacent wall.

19. The device of claim 16, further comprising a thermal sensor and a weight sensor carried by the lower housing; wherein the thermal sensor is configured to sense a temperature of an interior area defined by the wall; and wherein the weight sensor is in communication with the mount and detects a weight of the sports equipment carried by the mount.

* * * * *